US007356282B2

(12) United States Patent
Deguchi

(10) Patent No.: US 7,356,282 B2
(45) Date of Patent: Apr. 8, 2008

(54) IMAGE FORMING APPARATUS HAVING TRANSFER ROLLER GUIDED BY GUIDE DEVICE FIXED ON IMAGE CARRIER SUPPORT STRUCTURE AND PROCESS CARTRIDGE HAVING THE GUIDE DEVICE

(75) Inventor: Hideaki Deguchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 63 days.

(21) Appl. No.: 11/130,159

(22) Filed: May 17, 2005

(65) Prior Publication Data

US 2005/0254854 A1 Nov. 17, 2005

(30) Foreign Application Priority Data

May 17, 2004 (JP) ..... 2004-146971

(51) Int. Cl.
*G03G 15/00* (2006.01)

(52) U.S. Cl. ..... 399/111

(58) Field of Classification Search ..... 399/111, 399/110, 107

See application file for complete search history.

(56) References Cited

U.S. PATENT DOCUMENTS 6,041,203 A 3/2000 Suzuki et al.
6,330,410 B1 12/2001 Okabe et al.
6,411,789 B1 6/2002 Okabe et al.
6,546,217 B2 4/2003 Okabe et al.
6,690,903 B2 2/2004 Okabe et al.
2003/0118370 A1* 6/2003 Okabe et al. ..... 399/113
2004/0126132 A1 7/2004 Okabe et al.

FOREIGN PATENT DOCUMENTS

JP 05072833 A * 3/1993
JP 5333721 12/1993

* cited by examiner

*Primary Examiner*—Quana Grainger
(74) *Attorney, Agent, or Firm*—Banner & Witcoff, Ltd

(57) ABSTRACT

An image forming apparatus including an image carrier for carrying an image formed of a developing agent, a transfer roller disposed adjacent to the image carrier and having a roller shaft and a roller portion formed on the roller shaft to transfer the image of the developing agent from the image carrier onto a recording medium, a support structure supporting the image carrier and the transfer roller such that the image carrier and the transfer roller are removable together from a main body of the apparatus, a guide portion disposed on the support structure, to guide the roller shaft in a guiding direction toward and away from the image carrier, and a biasing device for abutting contact with the roller shaft to bias the roller shaft toward the image carrier. Also disclosed in a process cartridge including a housing structure supporting the image carrier and the transfer roller and provided with the guiding device, wherein the roller shaft is biased toward the image carrier by the biasing device.

24 Claims, 4 Drawing Sheets

IMAGE FORMING APPARATUS HAVING TRANSFER ROLLER GUIDED BY GUIDE DEVICE FIXED ON IMAGE CARRIER SUPPORT STRUCTURE AND PROCESS CARTRIDGE HAVING THE GUIDE DEVICE

The present application is based on Japanese Patent Application No. 2004-146971 filed on May 17, 2004, the contents of which are incorporated herein by reference.

BACKGROUND OF THE INVENTION

1. Field of the Invention

The present invention relates to an image forming apparatus such as a laser printer, and a process cartridge to be removably installed in the image forming apparatus.

2. Discussion of Related Art

An image forming apparatus such as a laser printer includes an image carrier in the form of a photoconductive drum that carries a toner image formed according to image data, and a transfer roller for transferring the toner image from the photoconductive drum to a recording medium in the form of a sheet of paper. The transfer roller is disposed adjacent to the photoconductive drum such that the outer circumferential surface of the transfer roller is held in rolling contact with the outer circumferential surface of the photoconductive drum. The toner image formed on the outer circumferential surface of the photoconductive drum is transferred to the paper sheet, by application of a bias voltage to the transfer roller, while the paper sheet is passed through a nip between the photoconductive drum and the transfer roller.

In the image forming apparatus of such a type as described above, the transfer roller is either installed in the main body of the apparatus, or built in a process cartridge that is to be removably installed in the main body. In the former case, the transfer roller is rotatably supported at the opposite end portions of its shaft by a pair of bearings fixed to the main body of the apparatus via respective springs interposed therebetween. The springs bias the respective bearings in a direction toward the photoconductive drum so that the transfer roller is forced onto the photoconductive drum. Each bearing has a groove open in the direction toward the photoconductive drum, so that the corresponding end portion of the shaft of the transfer roller is fitted into and removed from the groove. An example of the arrangement in which the transfer roller is installed in the main body is disclosed in JP-5-333721A.

In the arrangement in which the transfer roller is built in the process cartridge to be installed in the main body of the image forming apparatus, on the other hand, the transfer roller is rotatably supported at the opposite end portions of its shaft by a pair of U-shaped bearings fixed to the process cartridge. Each bearing is movable in the radial direction of the transfer roller, so that the transfer roller and the photoconductive drum are movable toward and away from each other. The main body is provided with a pusher member for abutting contact with the corresponding bearing on its side remote from the photoconductive drum, and a spring for biasing the pusher member toward the bearing, so that when the process cartridge is installed in the main body, the pusher members push the respective bearings so as to force the transfer roller into pressing contact with the photoconductive drum. When the process cartridge is removed from the main body, the pusher members are released from the bearings, to permit the transfer roller to be moved away from the photoconductive drum. An example of this arrangement is disclosed in U.S. Pat. Nos. 6,041,203A, 6,330,410B1, 6,411,789B1, 6,546,217B2, 6,690,903B2 and 2004126132A1.

When the used transfer roller installed in the main body of the apparatus is removed from the main body, for replacement with a new one, for instance, it is necessary to first remove the photoconductive drum from the main body, and then release the transfer roller shaft from the bearings, for removing the transfer roller from the main body. Thus, the removal of the transfer roller is relatively cumbersome. When the transfer roller is built in the process cartridge, the transfer roller can be relatively easily removed from the main body by removing the process cartridge from the main body. However, this arrangement requires the provision of the bearings and the pusher members for abutting contact with the bearings, unfavorably increasing the number of the required components of the image forming apparatus, and the structural complexity and difficulty of assembling and the cost of manufacture of the apparatus.

SUMMARY OF THE INVENTION

It is therefore a first object of the present invention to provide an image forming apparatus which permits easy removal of the transfer roller from its main body and which has a reduced number of components. A second object of this invention is to provide a process cartridge which permits easy removal of the transfer roller from its main body and reduces the number of components of an image forming apparatus in which the process cartridge is installed.

The first object may be achieved according to one aspect of this invention, which provides an image forming apparatus comprising: an image carrier for carrying an image formed of a developing agent; a transfer roller disposed adjacent to the image carrier and including a roller shaft and a roller portion formed on the roller shaft, the transfer roller being operable to transfer the image of the developing agent from the image carrier onto a recording medium; a support structure supporting the image carrier and the transfer roller such that the image carrier and the transfer roller are removable together from a main body of the image forming apparatus; a guide portion disposed on the support structure, to guide the roller shaft of the transfer roller in a predetermined guiding direction toward and away from the image carrier; and a biasing device operable for abutting contact with the roller shaft to bias the roller shaft toward the image carrier.

In the image forming apparatus constructed according to the first aspect of the present invention, the transfer roller and the image carrier are supported by the support structure such that the transfer roller and the image carrier are removable together from the main body of the apparatus, so that the transfer roller can be easily removed from the main body of the apparatus, together with the image carrier.

Further, the roller shaft of the transfer roller is biased toward the image carrier by the biasing device, in abutting contact with the biasing device, while the roller shaft is guided by the guiding device, so that the roller portion of the transfer roller is held in pressing contact with the image carrier, with the recording medium being nipped between the roller portion and the image carrier. Accordingly, the transfer roller is positioned rotatably relative to the image carrier, without an exclusive bearing device for rotatably supporting the transfer roller at its roller shaft. This arrangement makes it possible to eliminate an exclusive bearing device for rotatably supporting the transfer roller, reduce the number of the required components of the image forming apparatus, simplify the assembling of the apparatus and accordingly reduce the cost of its manufacture.

The second object indicated above may be achieved according to another aspect of the present invention, which provides a process cartridge removably installable in an image forming apparatus which includes a biasing device, comprising: an image carrier for carrying an image formed of a developing agent; a transfer roller disposed adjacent to the image carrier and including a roller shaft and a roller portion formed on the roller shaft, the transfer roller being operable to transfer the image of the developing agent from the image carrier onto a recording medium while the roller shaft is biased toward the image carrier by the biasing device, to hold the roller portion in pressing contact with the image carrier, with the recording medium being nipped between the roller portion and the image carrier; a housing structure supporting the image carrier and the transfer roller; and a guiding device disposed on the housing structure, to guide the roller shaft of the transfer roller in a predetermined guiding direction toward and away from the image carrier.

According to the process cartridge constructed according to the second aspect of this invention wherein the transfer roller is provided, the transfer roller can be easily installed into and removed from the main body of the image forming apparatus, by installing and removing the process cartridge into and from the main body of the apparatus.

When the process cartridge is installed into the main body of the image forming apparatus, the roller shaft of the transfer roller is biased toward the image carrier by the biasing device, in abutting contact with the biasing device, while the roller shaft is guided by the guiding device, so that the roller portion of the transfer roller is held in pressing contact with the image carrier, with the recording medium being nipped between the roller portion and the image carrier, after the process cartridge is installed in the main body. Accordingly, the transfer roller is positioned rotatably relative to the image carrier, without an exclusive bearing device for rotatably supporting the transfer roller at its roller shaft. This arrangement makes it possible to eliminate an exclusive bearing device for rotatably supporting the transfer roller, reduce the number of the required components of the image forming apparatus, simplify the assembling of the apparatus and accordingly reduce the cost of its manufacture.

BRIEF DESCRIPTION OF THE DRAWINGS

The above and other objects, features, advantages and technical and industrial significance of the present invention will be better understood by reading the following detailed description of a preferred embodiment of the invention, when considered in connection with the accompanying drawings, in which.

DETAILED DESCRIPTION OF THE PREFERRED EMBODIMENT

Figure 1:
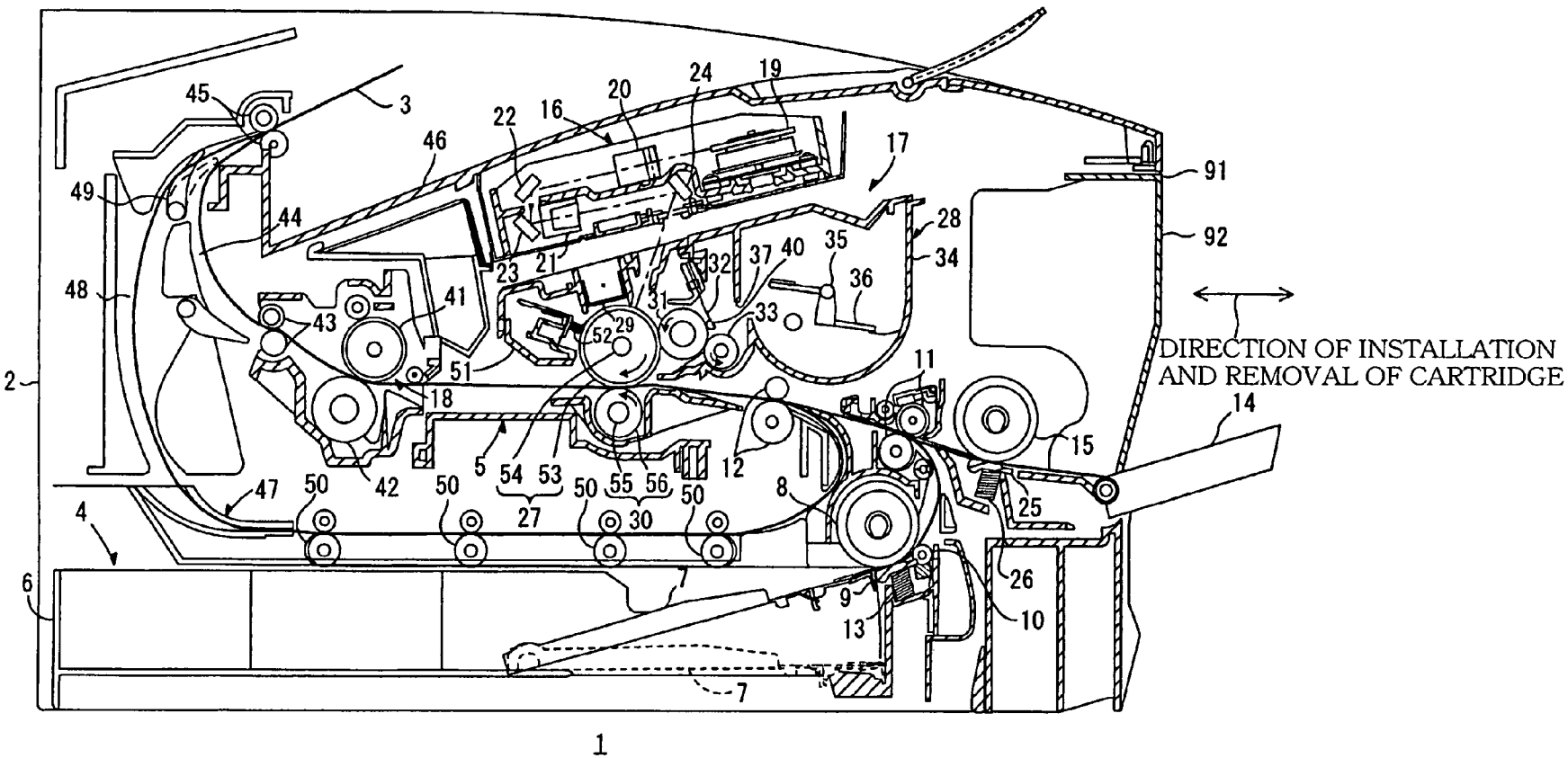
FIG. 1 is a side elevational view showing in cross section major elements of an image forming apparatus in the form of a laser printer constructed according to one embodiment of the present invention.

Referring first to the side elevational cross sectional view of FIG. 1, there is shown an image forming apparatus in the form of a laser printer constructed according to one embodiment of the present invention. As shown in FIG. 1, the laser printer denoted generally by reference numeral 1 has a main body casing 2, which houses a feeder portion 4 arranged to feed a recording medium in the form of a sheet of paper 3, and an image forming portion 5 arranged to form an image on the sheet of paper 3.

In an upper wall of the main body casing 2, which is located in a right-side end portion of the casing 2 as seen in FIG. 1, there is provided an operator's control panel having control keys and an LED indicator portion (including light emitting diodes). In a front wall of the main body casing 2, which is on the side of the operator's control panel, there is formed an access opening 91 through which a process cartridge 17 (which will be described) is installed into and removed from the main body casing 1. To the right-side end portion of the casing 2, there is pivotally attached a front covering 92 for opening and closing the access opening 91. Namely, a support shaft is provided to pivotally support the front covering 92 at its lower end, so that the access opening 91 is closed by the front covering 92 placed its closed position, and is opened when the front covering 92 is pivoted about the support shaft into its open position, to install or remove the process cartridge 17 into or from the main body casing 2.

The right side of the main body casing 2 on the side of the front covering 92 will be referred to as "a front side" of the laser printer 1 while the left side will be referred to as "a rear side" of the laser printer 1.

The feeder portion 4 is housed in a bottom portion of the main body casing 2, and includes a removably installable sheet supply tray 6, a paper presser plate 7 disposed within the sheet supply tray 6, a sheet supply roller 8 and a sheet supply pad 9 which are located above the front end portion of the sheet supply tray 6, paper-dust removing rollers 10, 11 located downstream of the sheet supply roller 8 as seen in a feeding direction of the paper sheet 3, and a pair of registering rollers 12 located downstream of the paper-dust removing rollers 10, 11 as seen in the feeding direction of the paper sheet 3.

A stack of paper sheets 3 is placed on the paper presser plate 7, which is supported pivotally about a pivot axis at its end remote form the sheet supply roller 8, such that the other end is vertically movable when the paper presser plate 7 is pivoted about the pivot axis. The paper presser plate 7 is biased by a spring (not shown) in the upward direction, so that the paper presser plate 7 is pivotable in the downward direction against the biasing action of the spring, as the thickness of the stack of paper sheets 3 increases. The sheet supply pad 9 is biased by a spring 13 disposed behind the sheet supply pad 9, so that the sheet supply pad 9 is held in pressing contact with the sheet supply roller 8 under the biasing action of the spring 13.

An uppermost one of the paper sheets 3 stacked on the paper presser plate 7 is forced onto the outer circumferential surface of the sheet supply roller 8 under the biasing action of the spring biasing the paper presser plate 6, and is advanced out of the sheet supply tray 6 by a rotary motion of the sheet supply roller 8, through a pressure nip between the sheet supply roller 8 and the sheet supply pad 9. Thus, the paper sheets 3 are fed one after another from the sheet supply tray 6 by the feeder portion 6.

The paper sheet 3 thus fed from the sheet supply tray 6 is passed through a nip between the paper-dust removing rollers 10, 11, so that paper dust is removed from the surfaces of the paper sheet 3. Then, the paper sheet 3 is passed through a nip between the pair of registering rollers 12, which are arranged to register the paper sheet 3 such that the leading edge of the paper sheet 3 is parallel to the axes of the registering rollers 12, so that the paper sheet 3 is registered at an image forming position at which a toner image is transferred from an image carrier in the form of a photoconductive drum 27 onto the paper sheet 3. In the present embodiment, the image forming position is defined by a pressure nip between the photoconductive drum 27 and a transfer roller 30.

The feeder portion 4 further includes a multi-purpose tray 14, and a multi-purpose tray sheet supply roller 15 and a multi-purpose tray sheet supply pad 25 which are provided to feed the paper sheets from the multi-purpose tray 14. These sheet supply roller 15 and sheet supply pad 25 are held in pressing contact with each other, under the biasing action of a spring 26 which is located behind the sheet supply pad 25 and biases the sheet supply pad 25 toward the sheet supply roller 15.

The paper sheets 3 stacked on the multi-purpose tray 14 are fed one after another from the tray 14 by a rotary motion of the sheet supply roller 15, through a pressure nip between the sheet supply roller 15 and sheet supply pad 25.

The image forming portion 5 includes a scanner portion 16, the previously indicated process cartridge 17, and an image fixing portion. The scanner portion 16 is disposed in an upper portion of the main body casing 2, and includes a laser source (not shown), a rotary polygon mirror 19, lenses 20, 21 and reflecting mirrors 22, 23, 24. A laser beam which is generated from the laser source is modulated according to image data representative of an image to be formed on the paper sheet 3, as well known in the art. The thus modulated laser beam is directed to the outer circumferential surface of the photoconductive drum 27, along an optical path indicated by one-dot chain line in FIG. 1. The optical path is defined by the polygon mirror 19, lens 20, reflecting mirrors 22, 23, lens 21 and reflecting mirror 24, which are arranged in this order of description along the optical path. The outer circumferential surface of the photoconductive drum 27 is irradiated with the modulated laser beam with a high scanning operation of the scanner portion 16.

Figure 2:
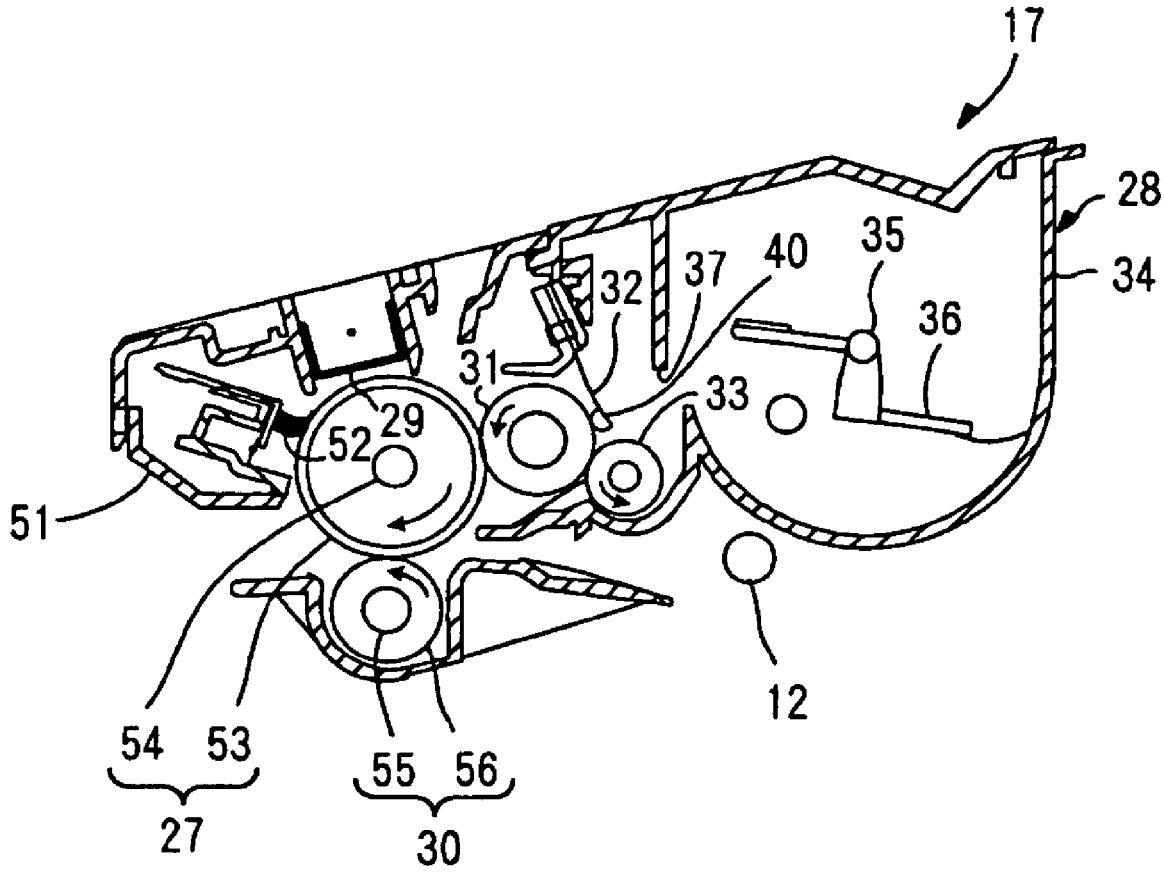
FIG. 2 is a side elevational view in cross section of a process cartridge used for the laser printer shown in FIG. 1.

The process cartridge 17 is removably installed in a portion of the main body casing 2, which is located below the scanner portion 16. As shown in FIG. 2, the process cartridge 17 includes a support structure in the form of a housing structure 51, the above-indicated photoconductive drum 27 accommodated in the housing structure 51 and functioning as a toner image carrier, a developing cartridge 28, a Scorotron type charger 29, the previously indicated transfer roller 30, and an electrically conductive brush 52.

As described above, the process cartridge 17 can be installed in the main body casing 2, by horizontally moving the process cartridge 17 toward the rear side of the laser printer 1, through the access opening 91 when the front covering 92 is in the open position. The process cartridge 17 can be removed from the main body casing 2, by horizontally pulling the process cartridge 16 toward the front side of the laser printer 1.

As described in greater detail, the photoconductive drum 27 takes the form of a cylinder, and includes a cylindrical drum body 53, and a drum shaft 54 which is made of a metallic material and coaxial with the drum body 53, extending in the axial direction of the drum body 53. The drum body 53 has a positively chargeable photosensitive layer including an outermost layer which is formed of polycarbonate, for example. The drum shaft 54 is supported by the housing structure 51 such that the drum shaft 54 is not rotatable relative to the housing structure, while the drum body 53 is rotatably supported by the drum shaft 54. Thus, the photoconductive drum 27 is accommodated in the housing structure 51 such that the drum body 53 is rotatable about the drum shaft 54.

The developing cartridge 28 is removably accommodated in the housing structure 51, and includes a developing roller 31, a toner-layer thickness regulator blade 32, a toner supply roller 33 and a toner hopper 34. The toner hopper 34 accommodates a developing agent in the form of a positively chargeable non-magnetic one-component toner, which is preferably a polymerized toner produced by copolymerizing, in a known polymerizing method such as suspension polymerization, polymerized monomers, for example, styrene monomers such as styrene, and acrylic monomers such as acrylic acid, alkyl(C1-C4) acrylate and alkyl(C1-C4) methacrylate. The polymerized toner, which is a powder of spherical particles, has an extremely high degree of fluidity and permits formation of a high-quality image.

The toner may contain a coloring agent such as carbon black, and a wax, and may contain an additive such as silica for improving the fluidity. The particle size of the toner is preferably within a range of about 6-10 μm. The toner within the toner hopper 34 is agitated by an agitator 36 supported by a drive shaft 35 which is located in a central portion of the toner hopper 34. The thus agitated toner is delivered through a toner exit 37 formed through a side wall of the toner hopper 34, which is adjacent to the toner supply roller 33.

The toner supply roller 33 is disposed adjacent to the toner exit 37, and is rotatably supported by the developing cartridge 28. This toner supply roller 33 includes a metallic roller shaft and a roller portion which is formed of an electrically conductive foam material and which covers the roller shaft.

The developing roller 31 is located on one side of the toner supply roller 33 which is relatively remote from the toner exit 37. The developing roller 31 is rotatably supported by the developing cartridge 28, and includes a metallic roller shaft and a roller portion which is formed of an electrically conductive rubber material and which covers the roller shaft. The roller portion of the developing roller 31 has a roller layer formed of an electrically conductive urethane or silicone rubber which contains fine particles of carbon and which is covered by a coating layer formed of an urethane or silicone rubber containing fluorine. The developing roller 31 is held in pressing rolling contact with the toner supply roller 33, and in rolling contact with the photoconductive drum 27 while the developing cartridge 28 is installed in the housing structure 51. To develop a latent image on the photoconductive drum 27 into a toner image by the developing roller 31, a developing bias voltage is applied to the developing roller 31.

The toner-layer thickness regulator blade 32 includes a blade body in the form of a metallic sheet spring, and a presser 45 fixed at a distal end portion of the sheet spring. The presser 45 has a semi-circular shape in cross section and is formed of an electrically insulating silicone rubber. The toner-layer thickness regulator blade 32 is supported at its proximal end by the developing cartridge 28, at a position right above the developing roller 31, such that the presser 40 is held in pressing contact with the developing roller 31 under a biasing force of the blade body.

A portion of the toner delivered through the toner exit 37 is transferred onto the developing roller 31 by a rotary motion of the toner supply roller 33 in the counterclockwise direction indicated by an arrow in FIG. 1, and is positively friction-charged between the toner supply roller 33 and the developing roller 31. The toner lying on the outer circumferential surface of the developing roller 31 is introduced into a pressure nip between the presser 40 of the toner-layer thickness regulator blade 32 and the developing roller 31, so that the outer circumferential of the developing roller 31 is covered by a relatively thin toner layer having a predetermined thickness.

The Scorotron type charger 29 is supported by the housing structure 41 such that the charger 29 is located above and in a spaced-apart relationship with the photoconductive drum 27. This charger 29 is of a positive charging type having a charging wire formed of tungsten, for example, which is capable of effecting a corona discharge for evenly and positively charging the outer circumferential surface of the photoconductive drum 27.

As described below in detail, the toner transfer roller 30 is rotatably supported by the housing structure 51, such that the toner transfer roller 30 is located below and held in pressing rolling contact with the photoconductive drum 27, so as to form a pressure nip therebetween. This toner transfer roller 30 includes a metallic roller shaft 55, and a roller portion 56 which is formed of an electrically conductive rubber material on the roller shaft 55, so as to cover the roller shaft 55. To transfer the toner image from the photoconductive drum 27 onto the paper sheet 3, a transfer bias voltage is applied to the toner transfer roller 30.

The electrically conductive brush 52 is located on the rear side of the photoconductive drum 27 (which is remote from the developing roller 31), and is supported by the housing structure 51 such that the distal end of the brush 52 is held in contact with the outer circumferential surface of the photoconductive drum 27. The outer circumferential surface of the photoconductive drum 27 is first evenly positively charged by the charger 29, and is then exposed to the modulated laser beam generated from the scanner portion 16, to form a latent image according to the image data.

Subsequently, the toner carried and positively charged by the developing roller 31 is brought into contact with the photoconductive drum 27, by a rotary motion of the developing roller 31, so that the latent image is developed into a visible toner image. Namely, the toner is transferred to local portions of the evenly positively charged outer circumferential surface of the photoconductive drum 27, which local portions have been exposed to the laser beam and have reduced potential values.

While the paper sheet 3 is fed through the pressure nip between the photoconductive drum 27 and the toner transfer roller 30, with rotary motions of the drum 27 and roller 30, the toner image is transferred from the photoconductive drum 27 onto the paper sheet 3. Paper dust adhering to the outer circumferential surface of the photoconductive drum 27 as a result of its contact with the paper sheet 3 for transferring the toner image onto the paper sheet 3 is brought into contact with the electrically conductive brush 52 with a further rotary motion of the drum 27, so that the paper dust is removed by the brush 52.

The image fixing portion 18 is disposed on the rear side of the process cartridge 17, and downstream of the drum 17 as seen in the feeding direction of the paper sheet 3, as shown in FIG. 1. The image fixing portion 18 includes a heating roller 41, a presser roller 42 held in pressing contact with the heating roller 41, and a pair of feed rollers 43 located downstream of the heating and presser rollers 41, 42 as seen in the feeding direction of the paper sheet 3.

The heating roller includes a halogen lamp accommodated in a metallic tube and arranged to generate heat for thermally fixing the toner image transferred onto the paper sheet 3 by the process cartridge 17, while the paper sheet 3 is passed through a pressure nip between the heating roller 41 and the presser roller 42. Then, the paper sheet 3 is fed by the feed rollers 43 along a sheet ejection path 44. The paper sheet 3 introduced into the sheet ejection path 44 is further fed by sheet ejector rollers 45, so as to be received by an sheet receiver tray 46.

In the present laser printer 1, the residual toner remaining on the photoconductive drum 27 after the toner image is transferred onto the paper sheet 3 with the aid of the toner transfer roller 30 is recovered by the developing roller 31, without an exclusive drum cleaner. This toner recovery arrangement simplifies the construction of the laser printer 1, eliminating not only the exclusive drum cleaner to clean the photoconductive drum 27 to remove the residual toner but also a reservoir for storing the removed residual toner.

The present laser printer 1 is provided with a reversing portion 47 for forming a toner image on the back surface of the paper sheet 3 after the toner image has been formed on the front surface. The reversing portion 47 includes the sheet ejector rollers 45 indicated above, a reversing path 48, a flapper 49 and a plurality of reverse feeding rollers 50. The sheet ejector rollers 45 are rotated in a selected one of opposite directions, to permit the paper sheet 3 not only in the forward direction so as to be received by the sheet receiver tray 46, but also in the reverse direction along a reversing path 48.

The reversing path 48 extends substantially vertically, for guiding the paper sheet 3 from the sheet ejector rollers 45 to an array of a plurality of reverse feeding rollers 50 which are located below the process cartridge 17 and the image fixing portion 18, and above the feeder portion 4. The upstream end of the reversing path 48 is located close to the sheet ejector rollers 45, while the downstream end is located close to the rearmost one of the reverse feeding rollers 50.

The flapper 49 is pivotally disposed near a point of merging of the sheet ejection path 44 and the reverse feeding path 48, and is pivoted by a solenoid-operated actuator (not shown) between a first position for guiding the paper sheet 3 along the sheet ejection path 44 in the forward feeding direction, and a second position for guiding the paper sheet 3 fed by the sheet ejector rollers 45 in the reverse direction, along the reversing path 48.

The reverse feeding rollers 50 are located above the sheet supply tray 6 and arranged in the horizontal direction, such that the most upstream roller 50 is located near the downstream end of the reversing path 48, while the most downstream roller 50 is located near and below the registering rollers 12.

When a toner image is formed on the back surface of the paper sheet 3, the reversing portion 47 is operated in the manner as described below. That is, the paper sheet 3 carrying a toner image already formed on its front surface is fed in the forward direction along the sheet ejection path 44 and passed through the nip of the sheet ejector rollers 45, and the rollers 45 are rotated in the forward direction to further feed the paper sheet 3 until a most of the entire length of the paper sheet 3 that includes the leading end portion is located on the outer or upper side of the sheet ejector rollers 45 while the trailing end portion of the paper sheet 3 remains on the inner or lower side of the sheet ejector rollers 45. While the trailing end portion of the paper sheet 3 is still nipped between the sheet ejector rollers 45, the forward rotation of the sheet ejector rollers 45 is stopped, and the reverse rotation of the sheet ejector rollers 45 is initiated while at the same time the flapper 49 is pivoted to the above-indicated second position. Thus, the paper sheet 3 is fed in the reverse direction along the reversing path 48. After the paper sheet 3 has left the flapper 49, the flapper 49 is returned to the original first position for guiding the paper sheet 3 along the sheet ejection path 44.

Then, the paper sheet 3 fed in the reverse direction along the reversing path 48 reaches the reverse feeding rollers 50, and is further fed by the rollers 50 along a U-shaped path extending from the most downstream roller 50 to the nip of the registering rollers 12, so that the paper sheet 3 whose leading edge is located between the nip of the registering rollers 12 and the nip of the photoconductive drum 27 and the toner transfer roller 30 is reversed upside down with respect to the paper sheet 3 when it was initially passed through the nip of the registering rollers 12 by the rotation motion of the sheet supply roller 8. Accordingly, a toner image can be formed on the back surface of the paper sheet 3 when the paper sheet 3 thus reversed is passed again through the nip of the photoconductive drum 27 and the toner transfer roller 30.

Figure 3:
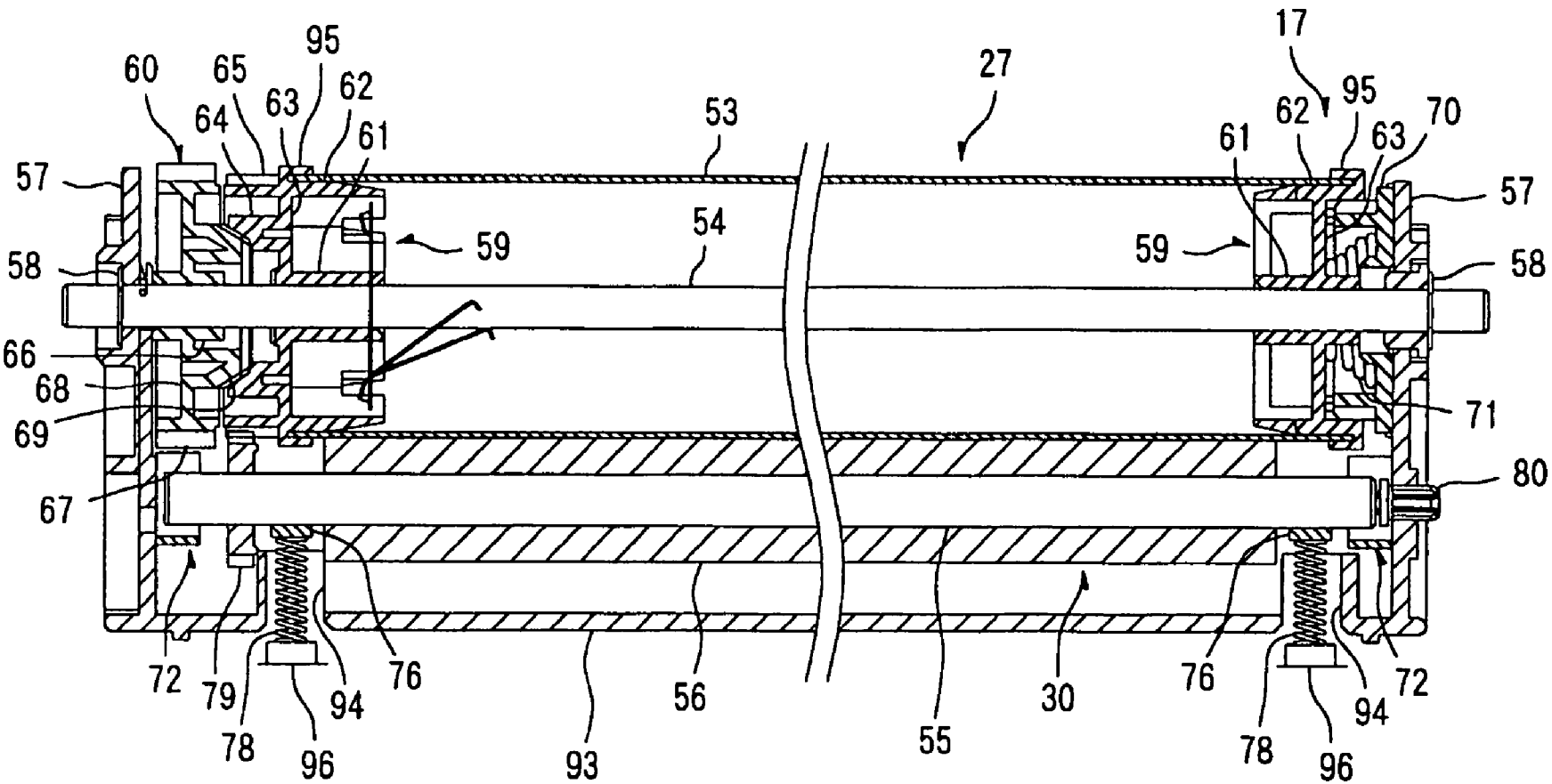
FIG. 3 is a cross sectional view of the process cartridge taken in a plane including axes of a photoconductive drum and a transfer roller of the process cartridge.

Reference is now made to the cross sectional view of FIG. 3 showing the process cartridge 17 in cross section taken in a plane including the axes of the drum shaft 54 and the roller shaft 55. As shown in FIG. 3, the housing structure 51 includes two side walls 57 which are opposed to and spaced apart from each other in the axial direction of the drum shaft 54 (roller shaft 55), and a lower wall 93 which connects the lower portions of the side walls 57. The lower wall 93 has two apertures in the form of slots 94 formed in the respective opposite end portions as seen in the above-indicated axial direction, such that the slots 94 extend in the horizontal direction from the front side toward the rear side of the laser printer 1. These slots 94 accommodate respective two abutting members 76 and respective two springs 78, which are provided in the main body casing 2, as described below.

The drum shaft 54 of the photoconductive drum 27 is a metallic shaft the opposite axial end portions of which extend through the respective side walls 57. The drum shaft 54 is fixed to the side walls 57 by retainers 58 such that drum shaft 54 is not rotatable relative to the side walls 57. Two flange members 59 are fitted on the respective axial end portions of the drum shaft 54 such that the flange members 59 are rotatable relative to the stationary drum shaft 54. The drum body 53 of the photoconductive drum 27 is fixed at its opposite axial end portions to the flange members 59, so that the drum body 53 is rotatably supported by the housing structure 51 via the drum shaft 54 and the flange members 59. A drum gear 60 is fitted on one of the axial end portions of the drum shaft 54 such that the drum gear 60 is rotatable relative to the drum shaft 54.

Each of the flange members 59 is formed of an electrically insulating resin material, and is fixed to the corresponding axial end portion of the drum body 53, so that the flange members 59 are rotated with the drum body 53. Each flange member 59 has an inner bearing portion 61 through which the drum shaft 54 extends, an outer fixing portion 62 fixedly inserted in the corresponding axial end portion of the drum body 53, and an intermediate connecting portion 63 connecting the inner bearing portion 61 and the outer fixing portion 62. The inner bearing portion 61, outer fixing portion 62 and intermediate connecting portion 63 are formed integrally with each other.

The inner bearing portion 61 is an inner sleeve portion which has an inside diameter substantially equal to the outside diameter of the drum shaft 54 and in which the corresponding axial end portion of the drum shaft 54 is fitted such that the bearing portion 61 is rotatable relative to the drum shaft 54. On the other hand, the outer fixing portion 62 is an outer sleeve portion which has an outside diameter substantially equal to the inside diameter of the drum body 53 and on which the corresponding axial end portion of the drum body 53 is fixedly fitted. The outer fixing portion 92 has a gripper 95 integrally formed at its axial end so as to extend from the outer circumferential surface, for gripping the axial end portion of the drum body 53.

The intermediate connecting portion 63 is an annular portion connecting the inner bearing portion 61 and the outer fixing portion 62 in the radial direction. One of the two flange members 59 (which is hereinafter referred to as "a first flange member 59") has, as integral parts thereof, a flange-side connector 64 connected to a drum roller gear 60 (described below) and an output gear 65 meshing with a transfer roller gear 79 (described below).

The flange-side connector 64 is formed so as to extend from a radially intermediate portion of the intermediate connecting portion 63, in the axial direction toward the side wall 57 corresponding to the first flange member 59. The output gear 65 is a cylindrical portion formed integrally with the outer fixing portion 62 such that the cylindrical portion extends in the axial direction toward the above-indicated side wall 57. The output gear 65 has a plurality of teeth which are formed in its outer circumferential surface and which mesh with the transfer roller gear 79.

The drum roller gear 60 is formed on the axially outer side of the output gear 65, and includes, as integral parts thereof, an inner bearing portion 66, an outer input gear 67, and an intermediate connecting portion 68 connecting the bearing portion 66 and the input gear 67. The drum shaft 54 extends through the inner bearing portion 66, and the input gear 67 meshes with a driven gear which is driven by a drum-drive electric motor (not shown) through a suitable power transmission mechanism.

The inner bearing portion 66 of the drum roller gear 60 is an inner sleeve portion which has an inside diameter substantially equal to the outside diameter of the drum shaft 54 and in which the corresponding axial end portion of the drum shaft 54 is fitted such that the bearing portion 66 is rotatable relative to the drum shaft 54. On the other hand, the outer input gear 67 is a cylindrical portion having a plurality of teeth which are formed in its outer circumferential surface and which mesh with the above-indicated driven gear. The gear-side connector 68 is an annular portion connecting the inner bearing portion 66 and the input gear 67 in the radial direction.

A gear-side connector 69 is formed integrally with the intermediate connecting portion 68, so as to extend from a radially intermediate portion of the connecting portion 68, in the axial direction toward the flange-side connector 64. As described below, this gear-side connector 69 is fixed to the flange-side connector 64 of the first flange member 59.

The flange-side connector 64 and the gear-side connector 69 are bonded to each other such that the bearing portion 61 of the first flange member 59 and the bearing portion 66 of the drum roller gear 60 are coaxially aligned with each other. Thus, the drum roller gear 60 is fixed to the flange member 59 in question, such that the first flange member 59 is rotated with the drum roller gear 60. The input gear 67 of the drum roller gear 60 may be formed integrally with the flange member 59 in question.

The bearing portion 61 of the first flange member 59 and the bearing portion 66 of the drum roller gear 60 are rotatably fitted on the corresponding axial end portion of the drum shaft 54 such that the inner circumferential surfaces of the bearing portions 61, 66 are slidable on the outer circumferential surface of the drum shaft 54, while the corresponding end portion of the drum body 53 is press-fitted between the outer circumferential surface of the outer fixing portion 62 and the gripper 95, so that the flange member 59 in question is rotated with the drum body 53.

The bearing portion 62 of the other flange member (second flange member) 59 is also fitted on the corresponding axial end portion of the drum shaft 54, and the corresponding end portion of the drum body 53 is press-fitted between the outer circumferential surface of the outer fixing portion 62 and the gripper 95, so that the second flange member 59 is also rotated with the drum body 53.

Thus, the two flange members 59 are fixed to the drum body 53 and supported by the drum shaft 54 such that the flange members 59 are not rotatable relative to the drum body 53, but are rotatable relative to the drum shaft 54. In other words, the photoconductive drum 27 is supported at its drum shaft 54 by the housing structure 51 through the flange members 59 such that the drum body 53 is rotatable relative to the drum shaft 54.

The side wall 57 corresponding to the second flange member 59 is provided with a spring seat 70 and a spring 71, which are located between this side wall 57 and the second flange member 59. The spring 71 is disposed between the spring seat 70 and the second flange member 59, and the drum shaft 54 extends through the spring seat 70 and the spring 71.

The spring seat 70 is an annular member having a ring portion held in contact with the inner surface of the side wall 57, and a cylindrical portion extending from the ring portion in the axially inward direction toward the second flange member 59. The spring 71 is a coil spring disposed around the corresponding axial end portion of the drum shaft 54, and seated on the ring portion of the spring seat 70, to bias the second flange member 59 in the axially inward direction. In this arrangement, the drum roller gear 60 provided on the first flange member 59 is held in pressing contact with the corresponding side wall 57 under the biasing action of the spring 71, so that the photoconductive drum 27 is axially positioned.

When the above-indicated driven gear meshing with the input gear 67 is rotated by the drum-drive electric motor provided in the main body casing 2, the input gear 67 is rotated to rotate the photoconductive drum 27, more precisely, the drum body 53.

Figure 4:
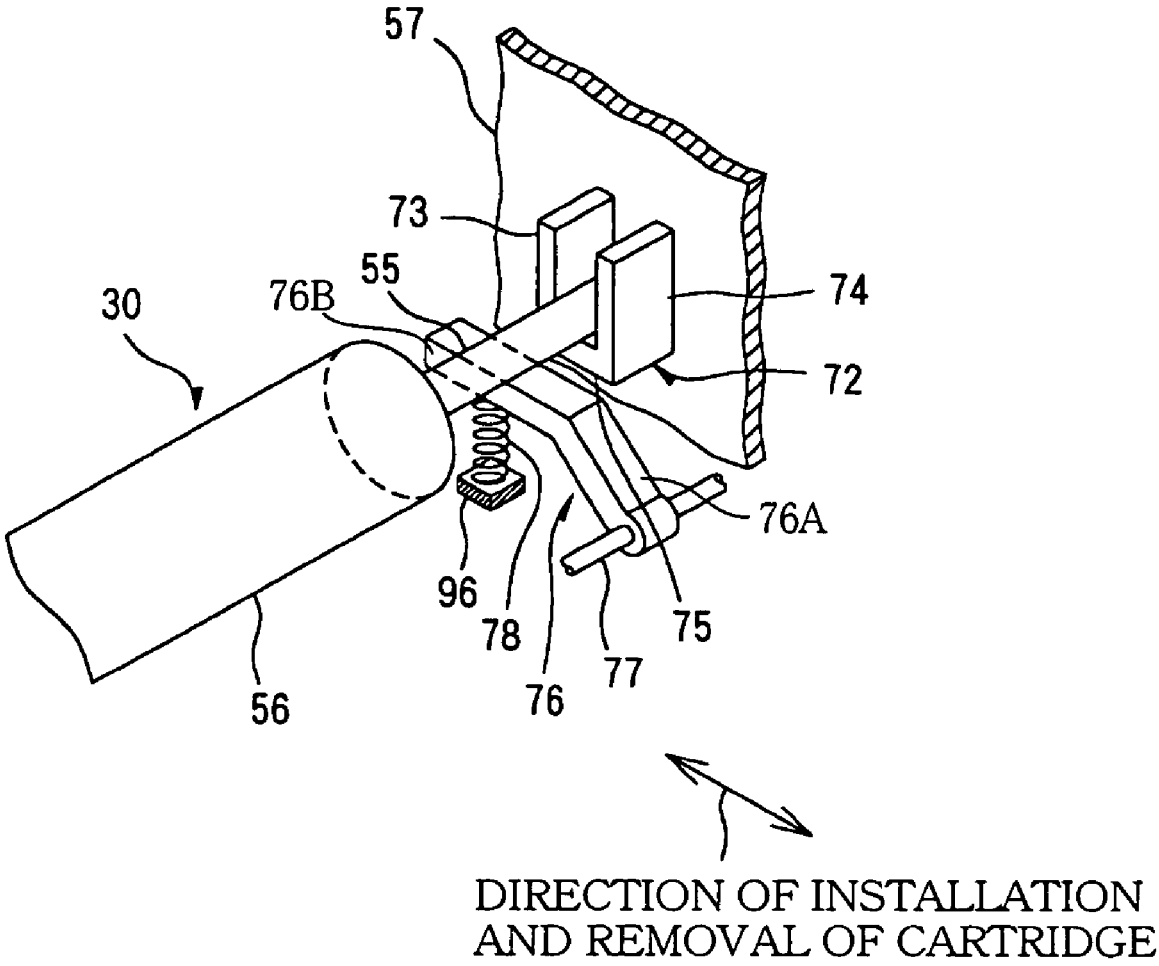
FIG. 4 is a schematic perspective view showing an arrangement near an end portion of the transfer roller which is remote from the end shown in FIG. 2

The roller shaft 55 of the toner transfer roller 30 has the opposite axial end portions extending axially outwardly from the respective opposite axial ends of the roller portion 56. As shown in FIG. 4, the side walls 57 of the housing structure 51 have respective integrally formed guides 72, which are provided as a guiding device to guide the roller shaft 55 at its opposite axial end portions such that the roller portion 56 is movable in a predetermined guiding direction (vertical direction) toward and away from the drum body 53 of the photoconductive drum 27. Thus the guiding device is fixedly disposed on the housing structure 51.

As shown in FIG. 4, each guide 72 of the guiding device has elongate rectangular first and second wall portions 73 and 74 which extend in the above-indicated predetermined guiding direction and which are opposed to and spaced apart from each other in a horizontal direction perpendicular to the guiding direction and the axial direction of the roller shaft 55. The guide 72 further has a rectangular third wall portion 75 which extends in the horizontal direction and which is located on a lower side of the roller shaft 55 remote from the photoconductive drum 27 in the guiding direction. The third wall portion 75 connects the first and second wall portions 73, 74 at their lower end portions remote from the photoconductive drum 27. Namely, the guide 72 is U-shaped and open toward the photoconductive drum 27 (more precisely, toward the axial end portion of the drum shaft 54). A spacing between the first and second wall portions 73, 74 is substantially equal to the diameter of the roller shaft 55. It is noted that while FIG. 4 shows only one of the two guides 72 which corresponds to the second flange member 59, and the elements located near this guide 72, the arrangement of the elements located near the other guide 72 corresponding to the first flange member 59 is identical with that of the elements near the guide 72 shown in FIG. 4.

The opposite axial end portions of the roller shaft 55 are received between the opposed first and second wall portions 73, 74 of the respective guides 72, and are guided in the guiding direction by the first and second wall portions 73, 74 in sliding contact with their opposed inner surfaces, while a movement of each axial end portion of the roller shaft 55 in the horizontal direction toward the rear side of the laser printer 1 is prevented by the first wall portion 73, and a movement of the axial end portion in the horizontal direction toward the front side of the laser printer 1 is prevented by the second wall portion 74. Thus, the first and second wall portions 73, 74 prevents the movements of the roller shaft 55 in the opposite horizontal directions perpendicular to the guiding direction (vertical direction), while permitting the movements of the roller shaft 55 in the guiding direction. Namely, the first and second wall portions 73, 74 permit accurate guiding of the roller shaft 55 in the guiding direction, and prevent the movements of the roller shaft 55 in the direction intersecting or perpendicular to the guiding direction, so that the toner transfer roller 30 is accurately positioned. Further, the third wall portion 75 prevents the roller shaft 55 from being removed from the guide 72 in the guiding direction away from the photoconductive drum 27, that is, in the downward direction.

The present laser printer 1 includes a biasing device for biasing the roller shaft 55 of the toner transfer roller 30 in the upward direction when the photoconductive drum 27 (process cartridge 17) is installed in the main body casing 2. The biasing device includes the above-indicated two abutting members 76 for abutting contact with the respective axial end portions of the roller shaft 55 in the upward direction toward the photoconductive drum 27, and the above-indicated two springs 78 for biasing the respective abutting members 76 toward the photoconductive drum 27.

Each abutting member 76 is a generally V-shaped member having two straight arms which form an obtuse angle. The two straight arms of each abutting member 76 consist of an inclined guide portion 76A and a horizontal support portion 76B. The guide portion 76A extends in a direction which intersects a direction of installation of the process cartridge 17 into the main body casing 2, such that the roller shaft 55 approaches the photoconductive drum 27 as the process cartridge 17 is moved for installation into the main body casing 2 while the roller shaft 55 is held in sliding contact with the guide portion 76A. The support portion 76B extends from the guide portion 76A in a substantially horizontal direction and is biased by the spring 78 against the roller shaft 55 in the guiding direction when the process cartridge 17 is installed in place in the main body casing 2. The abutting member 76 is disposed such that the support portion 76B is located under an axial portion of the roller shaft 55 which is between the guide 72 and the corresponding axial end face of the roller portion 56, when the process cartridge 17 is installed in place in the main body casing 2. The abutting member 76 is positioned relative to the roller shaft 55 such that the guide portion 76A which is on the rear side of the apex of the V-shape is inclined upwards for abutting contact with the roller shaft 55, while the support portion 76B on the front side of the apex is located on the front side of the roller shaft 55 and is biased upwards by the spring 78 when the process cartridge 17 is installed in place. The abutting member 76 generally extends in the direction in which the process cartridge 17 is installed into and removed from the main body of the laser printer 1, that is, in the feeding direction of the paper sheet 3.

On the front and lower sides of the roller shaft 55, a pivot shaft 77 is fixed to the main body casing 2 such that the pivot shaft 77 extends in the axial direction of the roller shaft 55. Each abutting member 76 is pivotally connected at its lower end of the guide portion 76A to the pivot shaft 77 such that the abutting member 76 is pivotable about the axis of the pivot shaft 77.

Each spring 78 is located under the support portion 76B of the corresponding V-shaped abutting member 76, in alignment with the axis of the roller shaft 55 in the horizontal direction perpendicular to the axis when the process cartridge 17 is installed in place in the main body casing 2. The spring 78 is a compression coil spring having a lower end fixed to a spring support plate 96 fixed to the main body casing 2, and an upper end fixed to the lower surface of the support portion 76B of the abutting member 76, so that the support portion 76B is biased upwards and held in pressing contact with the axial end portion of the roller shaft 55. In this state, the support portion 76B extends in the horizontal direction while the guide portion 76A whose front end is pivotally connected to the pivot shaft 77 is inclined upwards with respect to the horizontal plane, as described above.

To install the process cartridge 17 in the main body casing 2, the front covering 92 is opened, and the process cartridge 17 is moved into the main body casing 2 through the access opening 91, in the horizontal direction perpendicular to the axial direction of the photoconductive drum 27 and the toner transfer roller 30, while the process cartridge 17 is guided at a guiding portion thereof by a guiding portion of the main body casing 2. As a result, the abutting members 76 and the springs 78 are received in the slots 94 formed in the lower wall 93 of the housing structure 51 of the process cartridge 17, and the opposite axial end portions (second axial portions axially spaced apart from the above-described first axial portions) of the roller shaft 55 are brought into abutting contact with the guide portions 76A of the abutting members 76. Thus, the apertures in the form of the slots 94 function as an access structure which enables the roller shaft 55 to obtain an access to the biasing device 76, 78 when the process cartridge 17 is moved for installation in the main body casing 2. When the process cartridge 17 is further moved into the main body casing 2 in the horizontal direction toward the rear side of the laser printer 1, the second axial portions of the roller shaft 55 are slidably moved from the guide portions 76A onto the support portions 76B of the abutting members 76, and the springs 78 are slightly compressed, so that the roller shaft 55 is biased upwards under the biasing action of the springs 78, and is moved upwards with the first axial portions being guided between the first and second wall portions 73, 74 of the guide 72, until the roller portion 56 of the toner transfer roller 30 comes into pressing contact with the drum body 53 of the photoconductive drum 27.

In the process cartridge 17, the above-indicated transfer roller gear 79 is fixed to the axial end portion of the roller shaft 55 of the toner transfer roller 30, which axial end portion corresponds to the first flange member 59. As shown in FIG. 3, this transfer roller gear 79 is located between the guide 72, and a part of the above-indicated axial end portion of the roller shaft 55 which is brought into abutting contact with the abutting member 76 when the process cartridge 17 is installed in place. The transfer roller gear 79 has a plurality of outer teeth for meshing engagement with the outer gear 65 of the first flange member 59 when the roller portion 56 of the toner transfer roller 30 comes into pressing contact with the photoconductive drum 27. In the process cartridge 17 installed in place in the main body casing 2, when the photoconductive drum 27 is rotated by the electric motor (not shown) provided in the main body casing 2, a rotary motion of the photoconductive drum 27 is transmitted to the transfer roller gear 79 through the output gear 65, so that the toner transfer roller 30 is rotated in rolling contact with the photoconductive drum 27.

The side wall 57 of the housing structure 51 which corresponds to the second flange member 59 is provided with transfer electrode 80 for applying the transfer bias voltage to the toner transfer roller 30. These transfer electrode 80 is brought into abutting contact with a sheet spring (not shown) connected to a transfer bias voltage source (not shown) provided in the main body casing 2, when the process cartridge 17 is installed in place in the main body casing 2. The transfer electrode 80 is held in pressing contact with the corresponding axial end portion of the roller shaft 55 under the biasing action of the sheet spring, so that the transfer bias voltage is applied to the toner transfer roller 30 through the sheet spring and the transfer electrode 80.

In the present laser printer 1, the photoconductive drum 27 and the toner transfer roller 30 are supported by the housing structure 51 of the process cartridge 17 which is removably installed in the main body casing 2, so that the laser printer 1 can be simplified in construction, with a reduced number of the components, and the toner transfer roller 30 and the photoconductive drum 27 can be easily installed and removed together into and from the main body casing 2, by installing and removing the process cartridge 17 into and from the main body casing 2.

Further, the process cartridge 17 can be easily installed and removed through the access opening 91, by simply opening the front covering 92. When the process cartridge 16 is installed in place in the main body casing 2, the roller shaft 55 of the toner transfer roller 30 is guided by the guides 72, for pressing contact of the roller portion 56 with the drum body 53 of the photoconductive drum 27 by application of the biasing force of the springs 78 to the opposite axial end portions of the roller shaft 55 via the abutting members 76, for thereby positioning the toner transfer roller 30 relative to the photoconductive drum 27 in the vertical guiding direction, while at the same time the roller shaft 55 is prevented by the guides 72 from moving in the horizontal direction intersecting the vertical guiding direction, and is thereby positioned relative to the photoconductive drum 27 in the horizontal direction. Thus, the toner transfer roller 30 can be accurately positioned relative to the photoconductive drum 27 in not only the vertical guiding direction but also the horizontal direction perpendicular to the vertical guiding direction, such that the toner transfer roller 30 is in rolling contact with the drum body 53 of the photoconductive drum 27. This arrangement makes it possible to eliminate an exclusive bearing device for rotatably supporting the toner transfer roller 30, reduce the number of the required components of the laser printer 1, simplify the assembling of the laser printer 1 and accordingly reduce the cost of its manufacture.

It is also noted that the two guides 72 serving as the guiding device are provided for guiding the respective opposite axial end portions of the roller shaft 55, making it possible to accurately position the toner transfer roller 30 relative to the photoconductive drum 27, while eliminating exclusive bearings for rotatably supporting the roller shaft 55. Further, the simple biasing device consisting of the abutting members 76 and the springs 78 permits the roller shaft 55 to be biased against the photoconductive drum 27 in the intended manner, making it possible to reduce the number of the components and the cost of manufacture of the image forming apparatus in the form of the laser printer 1.

It is further noted that the rear art of each V-shaped abutting member 76 extends in the horizontal direction in which the process cartridge 17 is moved for installation into and removal from the main body casing 2. Accordingly, the abutting members 76 do not disturb smooth movements of the process cartridge 17 for installation and removal. In addition, the housing structure 51 of the process cartridge 17 function as a support structure for supporting the photoconductive drum 27 and the toner transfer roller 30 such that these components 27, 30 can be removed as a unit. This arrangement eliminates an exclusive support structure separate from the housing structure 51, for removably supporting the photoconductive drum 27 and toner transfer roller 30, and makes it possible to reduce the number of the components of the laser printer 1.

The present process cartridge 17 is further advantageous in that the two guides 72 are provided integrally with the respective two side walls 57 of the housing structure 51. This arrangement simplifies the construction of the process cartridge 17, and reduces the number of the components of the laser printer 1.

Although the laser printer 1 according to the illustrated embodiment described above is arranged such that the photoconductive drum 27 and the toner transfer roller 30 are both supported by the process cartridge 17, the principle of the present invention is equally applicable to an image forming apparatus wherein the photoconductive drum 27 and the toner transfer roller 30 can be installed and removed together into and from the main body casing 2 of the image forming apparatus, without using the process cartridge 27. For example, the process cartridge 27 may be replaced by a suitable holder member arranged to install and remove the photoconductive drum 27 and the toner transfer roller 30 into and from the main body casing 2.

It is to be understood that the present invention is not limited to the details of the illustrated embodiment, but may be otherwise embodied with various changes and modifications, which may occur to those skilled in the art, without departing from the spirit and scope of the invention defined in the following claims.

What is claimed is:

1. An image forming apparatus comprising:

an image carrier for carrying an image formed of a developing agent;

a transfer roller disposed adjacent to the image carrier and including a roller shaft and a roller portion formed on the roller shaft, the transfer roller being operable to transfer the image of the developing agent from the image carrier onto a recording medium;

a support structure supporting the image carrier and the transfer roller such that the image carrier and the transfer roller are removable together from a main body of the image forming apparatus;

a guide device fixedly disposed on and not movable relative to the support structure, to guide the roller shaft of the transfer roller in a predetermined guiding direction toward and away from the image carrier; and a biasing device operable for abutting contact with the roller shaft to bias the roller shaft toward the image carrier.

2. The image forming apparatus according to claim 1, wherein said guiding device permits movements of the roller shaft of the transfer roller in the predetermined guiding direction, and inhibits movements of the roller shaft in a direction intersecting the guiding direction.

3. The image forming apparatus according to claim 1, wherein said guiding device includes two guides for guiding respective opposite axial end portions of the roller shaft of the transfer roller.

4. The image forming apparatus according to claim 1, wherein said guiding device includes a first wall portion and a second wall portion which extend in the predetermined guiding direction and which are opposed to and spaced apart from each other in a direction intersecting the guiding direction, the guiding device guiding the roller shaft of the transfer roller in the guiding direction such that the roller shaft is received between the first and second wall portions.

5. The image forming apparatus according to claim 4, wherein said guiding device further includes a third wall portion which is located on one of opposite sides of the roller shaft of the transfer roller which is remove from the image carrier in the predetermined guiding direction, the third wall portion connecting the first and second wall portions.

6. The image forming apparatus according to claim 1, wherein said biasing device includes an abutting member for abutting contact with the roller shaft of the transfer roller in the predetermined guiding direction toward the image carrier, and a spring for biasing the abutting member against the roller shaft in the guiding direction toward the image carrier.

7. The image forming apparatus according to claim 1, including a process cartridge which is removably installable in said main body and which includes the image carrier, the transfer roller, the support structure and the guiding device.

8. The image forming apparatus according to claim 7, wherein said process cartridge has a housing structure which accommodates the image carrier and the transfer roller and which serves as said support structure, and wherein said guiding device is provided on the housing structure.

9. The image forming apparatus according to claim 8, wherein said guiding device is formed integrally with the housing structure.

10. The image forming apparatus according to claim 7, wherein said biasing device includes an abutting member for abutting contact with the roller shaft of the transfer roller in the predetermined guiding direction toward the image carrier, and a spring for biasing the abutting member against the roller shaft in the guiding direction toward the image carrier, said abutting member including a guide portion extending in a first direction intersecting a second direction in which the process cartridge is moved for installation into the main body, such that the roller shaft approaches the image carrier as the process cartridge is moved for installation into the main body while the roller shaft is held in sliding contact with said guide portion.

11. The image forming apparatus according to claim 10, wherein said abutting member further includes a support portion which extends from said guide portion in a direction substantially perpendicular to the guiding direction and which is biased by said spring against the roller shaft in the guiding direction when the process cartridge is installed in the main body.

12. The image forming apparatus according to claim 11, wherein said abutting member extends in a feeding direction of said recording medium is fed.

13. The image forming apparatus according to claim 12, wherein said main body has two end walls which are opposed to each other in the feeding direction of the recording medium, one of said two end walls having an access opening through which said process cartridge is installed into and removed from the main body.

14. The image forming apparatus according to claim 13, further comprising an operator's control portion disposed on an upper wall located on an end portion of the main body on the side of said one of said two end walls.

15. A process cartridge removably installable in an image forming apparatus which includes a biasing device, comprising:

an image carrier for carrying an image formed of a developing agent;

a transfer roller disposed adjacent to the image carrier and including a roller shaft and a roller portion formed on the roller shaft, the transfer roller being operable to transfer the image of the developing agent from the image carrier onto a recording medium while the roller shaft is biased toward the image carrier by said biasing device, to hold the roller portion in pressing contact with the image carrier, with the recording medium being nipped between the roller portion and the image carrier;

a housing structure supporting the image carrier and the transfer roller; and a guiding device formed integrally with and not movable relative to housing structure, to guide the roller shaft of the transfer roller in a predetermined guiding direction toward and away from the image carrier.

16. The process cartridge according to claim 15, wherein said housing structure comprises an access structure which enables said roller shaft of the transfer roller to obtain an access to said biasing device when the process cartridge is moved for installation into the main body.

17. The process cartridge according to claim 16, wherein said access structure includes an aperture formed such that the aperture permits the roller shaft of the transfer roller to come into abutting contact with said biasing device during a movement of the process cartridge for installation into the main body, and is held biased by the biasing device toward said image carrier when the process cartridge is installed in place in the main body.

18. The process cartridge according to claim 15, wherein said guiding device permits movements of the roller shaft of the transfer roller in the predetermined guiding direction, and inhibits movements of the roller shaft in a direction intersecting the guiding direction.

19. The process cartridge according to claim 15, wherein said guiding device includes two guides for guiding respective opposite axial end portions of the roller shaft of the transfer roller.

20. The process cartridge according to claim 15, wherein said guiding device includes a first wall portion and a second wall portion which extend in the predetermined guiding direction and which are opposed to and spaced apart from each other in a direction intersecting the guiding direction, the guiding device guiding the roller shaft of the transfer roller in the guiding direction such that the roller shaft is received between the first and second wall portions.

21. The process cartridge according to claim 20, wherein said guiding device further includes a third wall portion which is located on one of opposite sides of the roller shaft of the transfer roller which is remove from the image carrier in the predetermined guiding direction, the third wall portion connecting the first and second wall portions.

22. An image forming apparatus comprising:

an image carrier for carrying an image formed of a developing agent;

a transfer roller disposed adjacent to the image carrier and including a roller shaft and a roller portion formed on the roller shaft, the transfer roller being operable to transfer the image of the developing agent from the image carrier onto a recording medium;

a support structure supporting the image carrier and the transfer roller such that the image carrier and the transfer roller are removable together from a main body of the image forming apparatus;

a guide device fixedly disposed on the support structure, to guide the roller shaft of the transfer roller in a predetermined guiding direction toward and away from the image carrier; and a biasing device operable for abutting contact with the roller shaft to bias the roller shaft toward the image carrier, wherein said biasing device includes an abutting member for abutting contact with the roller shaft of the transfer roller in the predetermined guiding direction toward the image carrier, and a spring for biasing the abutting member against the roller shaft in the guiding direction toward the image carrier.

23. A process cartridge removably installable in an image forming apparatus which includes a biasing device comprising an abutting member and a spring for biasing the abutting member, comprising:

an image carrier for carrying an image formed of a developing agent;

a transfer roller disposed adjacent to the image carrier and including a roller shaft and a roller portion formed on the roller shaft, the transfer roller being operable to transfer the image of the developing agent from the image carrier onto a recording medium while the roller shaft is biased toward the image carrier by said biasing device, to hold the roller portion in pressing contact with the image carrier, with the recording medium being nipped between the roller portion and the image carrier;

a housing structure supporting the image carrier and the transfer roller; and a guiding device fixedly disposed on the housing structure, to guide the roller shaft of the transfer roller in a predetermined guiding direction toward and away from the image carrier, wherein said roller shaft of the transfer roller includes a first axial portion at which the roller shaft is guided by said guiding device in the predetermined guiding direction, and a second axial portion which is spaced apart from said first axial portion in an axial direction of the transfer roller and which is provided for abutting contact with the abutting member in the predetermined guiding direction, so that the roller shaft is biased by said spring through said abutting member.

24. A process cartridge removably installable in an image forming apparatus which includes a biasing device, comprising:

an image carrier for carrying an image formed of a developing agent;

a transfer roller disposed adjacent to the image carrier and including a roller shaft and a roller portion formed on the roller shaft, the transfer roller being operable to transfer the image of the developing agent from the image carrier onto a recording medium while the roller shaft is biased toward the image carrier by said biasing device, to hold the roller portion in pressing contact with the image carrier, with the recording medium being nipped between the roller portion and the image carrier;

a housing structure supporting the image carrier and the transfer roller; and a guiding device formed integrally with and not movable relative to the housing structure, to guide the roller shaft of the transfer roller in a predetermined guiding direction toward and away from the image carrier, such that the roller shaft moves relative to the guiding device.

* * * * *